US012758853B2

(12) United States Patent
Thesman

(10) Patent No.: US 12,758,853 B2
(45) Date of Patent: Oct. 13, 2026

(54) SPORT NECK GUARD WITH VERTICAL FASTENERS AND FABRIC FOLD TO PROTECT AGAINST CUTS AND LACERATIONS

(71) Applicant: Chase Michael Thesman, Santa Clarita, CA (US)

(72) Inventor: Chase Michael Thesman, Santa Clarita, CA (US)

( * ) Notice: Subject to any disclaimer, the term of this patent is extended or adjusted under 35 U.S.C. 154(b) by 0 days.

(21) Appl. No.: 18/977,595

(22) Filed: Dec. 11, 2024

(65) Prior Publication Data

US 2025/0186865 A1 Jun. 12, 2025

Related U.S. Application Data

(60) Provisional application No. 63/608,306, filed on Dec. 11, 2023.

(51) Int. Cl.
*A63B 71/12* (2006.01)

(52) U.S. Cl.
CPC .... *A63B 71/1291* (2013.01); *A63B 2209/023* (2013.01)

(58) Field of Classification Search
CPC ..... A41D 13/0512; A63B 71/1291; A63B 2209/023
See application file for complete search history.

(56) References Cited

U.S. PATENT DOCUMENTS

| | | | | | |
|---|---|---|---|---|---|
| 4,017,906 | A * | 4/1977 | Bochynsky | A42B 3/105 | 2/205 |
| 4,324,003 | A * | 4/1982 | Johnston | A63B 71/10 | 2/468 |
| 4,501,023 | A * | 2/1985 | Bilberry | A63B 71/1291 | 2/908 |
| 4,697,289 | A * | 10/1987 | Luigi | A42B 3/105 | 2/205 |
| 6,044,498 | A * | 4/2000 | Schumann | A41D 31/245 | 2/2.5 |
| 6,874,170 | B1 * | 4/2005 | Aaron | A63B 71/1291 | 2/468 |
| 2011/0010830 | A1 * | 1/2011 | Rosen | A63B 71/1291 | 2/468 |
| 2014/0196203 | A1 * | 7/2014 | Cole | F41H 1/02 | 24/305 |

* cited by examiner

*Primary Examiner* — Alissa L Hoey
*Assistant Examiner* — Akwokwo Olabisi Redhead

(57) ABSTRACT

A neck guard configured to protect a wearer's neck and throat from injury is provided. It comprises a continuous, slash-resistant tube defining inside and outside surfaces, and spaced apart top and bottom edges. The tube is sized to fit over the wearer's head for positioning around the neck, and the top edge is contoured to follow the shape of the wearer's jaw and skull. A plurality of means for securing the tube along both the top and bottom edges to other devices are provided as well to prevent the tube from drooping or otherwise moving out of place while being worn. The tube may be made from a seamless, knitted material using high-strength textile fibers such as aramid, para-aramid, polyethylene, ultra-high-molecular-weight polyethylene, or nylon, and it may also be blended with other rugged yet elastic materials. The neck guard can include foam padding attached to the tube for additional protection.

17 Claims, 7 Drawing Sheets

SPORT NECK GUARD WITH VERTICAL FASTENERS AND FABRIC FOLD TO PROTECT AGAINST CUTS AND LACERATIONS

CROSS-REFERENCE TO RELATED APPLICATIONS

This application claims benefits of U.S. Patent Application No. 63/608,306, filed on Dec. 11, 2023, which is incorporated herein by reference.

GOVERNMENT CONTRACT

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to protective sports equipment, and more particularly, to a neck guard configured to prevent injury to a player's throat and neck in ice hockey, ringette, and other sports and activities.

BACKGROUND

Hockey is a fast-paced contact sport played worldwide, with players reaching speeds of up to 25 miles per hour on sharpened, stainless-steel skates. These blades can easily cut through fabrics like cotton or polyester and even skin. While rare, such injuries can be severe or even fatal, prompting the development of cut-resistant gear for vulnerable areas including the neck, wrists, and ankles.

Neck guards presently available in the marketplace are typically made from foam or cut-resistant materials marketed under tradenames Kevlar® or Dyneema® and are often covered with moisture-wicking fabric for comfort. Some neck guards also include impact protection to absorb blows from pucks, sticks, or elbows. This impact protection may be integrated with the players' uniform and other protective equipment, such as shin guards, or removable. Some neck guards, in particular, have been integrated into other parts of the uniform, such as the collar of a jersey, undershirt, or even the helmet. Notable examples of proposed neck guards include U.S. Pat. No. 4,686,710 to Marsten et al.; WO 2019/194704 to Konovalov et al.; CA 2,012,375 to Carveth; and U.S. Pat. No. 11,206,879 to Peterson.

However, current neck guards feature a number of deficiencies that continue to hinder their widespread adoption. For instance, they often fail to provide complete coverage, especially around the back and upper neck near the ears and base of the skull. While some designs add flaps for extra protection, these often droop and rotate or fall out of place, leaving vulnerable areas exposed.

As another example, hook and loop and other types of fasteners create problems with both security and comfort. If the neck guard is fastened too tightly around the wearer's neck, it can cause discomfort and restrict breathing. If too loose, the neck guard shifts during play, compromising protection. Even when properly secured, the tightness of the guard can trap heat and reduce airflow, leading to discomfort. As a result of these deficiencies, some have proposed integrating neck guards directly into player uniforms to prevent shifting. While this can help with stability, the neck guards often droop at the top, requiring stiff, thick materials to hold them in place. These materials can be uncomfortable and restrict head movement and limit range of motion, as they create pressure against the head and face.

Thus, although various proposals have been made to solve the problem, none of those in existence combine the characteristics of the present invention. Therefore, there remains a need for a comfortable and ergonomic guard that effectively protects a player's neck and throat while preserving range of motion.

SUMMARY

The present disclosure is directed to a guard configured to protect a player's neck and throat from injury by sharp objects, projectiles, and other instruments of sport, including sticks, bats, poles, and the like. While specific reference may be made herein throughout to hockey and sporting equipment related to hockey for the sake of illustration and brevity, it is contemplated that the neck guard may be more generally utilized by players of a wide variety of sports including, but not limited to field, ice and street hockey; roller derby; broomball; ringette; baseball; lacrosse; dueling sports; martial arts; and others.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In some embodiments, the neck guard comprises a continuous, slash-resistant tube having an inside, outside, top edge, and bottom edge. The tube is configured to fit around a player's (or wearer's) neck and therefore sized to allow a wearer's head to pass through. It is contemplated that some degree of elasticity may be desired in order to allow the device to fit comfortably over the wearer's head while maintaining a relatively close fit around the wearer's neck, and therefore, in some embodiments, the tube may be at least somewhat elastic and resilient.

In an exemplary embodiment, the top edge may be shaped to follow the contours of the wearer's jaw and skull at the top of the neck when worn. To that end, a rear and top edge portion of the tube may be relatively higher in position that a front and top edge portion of the tube to effectuate protection of a significant portion, if not the entirety of, the wearer's neck and throat.

The tube may further comprise a plurality of mechanisms for securing the tube to one or more other devices from the top edge and the bottom edge of the tube. In some exemplary embodiments, one or more means for securing the tube to another device may comprise one or more straps extending from the bottom edge of the tube and configured to securely yet releasably engage with an anchor point on a garment or accessory worn on the upper body of a player, such as on shoulder pads, an undershirt, or jersey. In some embodiments, the straps may comprise complementary hook-and-loop fasteners or snaps, laces, buckles, buttons and/or buttonholes. In some embodiments, one or more means for securing the tube to another device may comprise one or more straps extending from the top edge of the tube and configured to securely yet releasably engage with an anchor point on a garment or accessory worn on or around the head of a player.

It is contemplated that means for securing the tube to another device from the top and bottom edges of the tube may be disposed on the tube to symmetrically anchor the tube in position from the wearer's left and right sides.

The slash-resistant material is a seamless, knitted textile made from high-strength fibers such as aramid, para-aramid, polyethylene, ultra-high-molecular-weight polyethylene, or nylon. The material may also be blended with additional materials for enhanced properties. In some embodiments, the tube may be knitted or otherwise configured to form a series of grooves, pleats, ribs, or indentations that allow the material to fold, bend, compress, and stretch ergonomically when a wearer's head moves during participation in sports activities and even, in some embodiments, throughout its entire range of motion.

Foam padding and even rigid plastic, metal, or composite plates may be secured to the tube for added protection.

It is contemplated that providing a neck guard according to the disclosure and claims provided below may protect a player's neck while engaging in sports activities.

Thus, it is an object of the invention to provide an ergonomic form of protection to the throat and neck.

It is another object of the invention to minimize disruption to a player's range of motion while protecting their throat and neck.

It is still another object of the invention to maintain flexibility and airflow in protective equipment.

It is yet another object of the invention to maximize the portions of a player's neck and throat protected while engaged in sports activities.

One or more of the above-disclosed embodiments, in addition to certain alternatives, are provided in further detail below with reference to the attached figures. The disclosed subject matter is not, however, limited to any particular embodiment disclosed.

Figure 1:
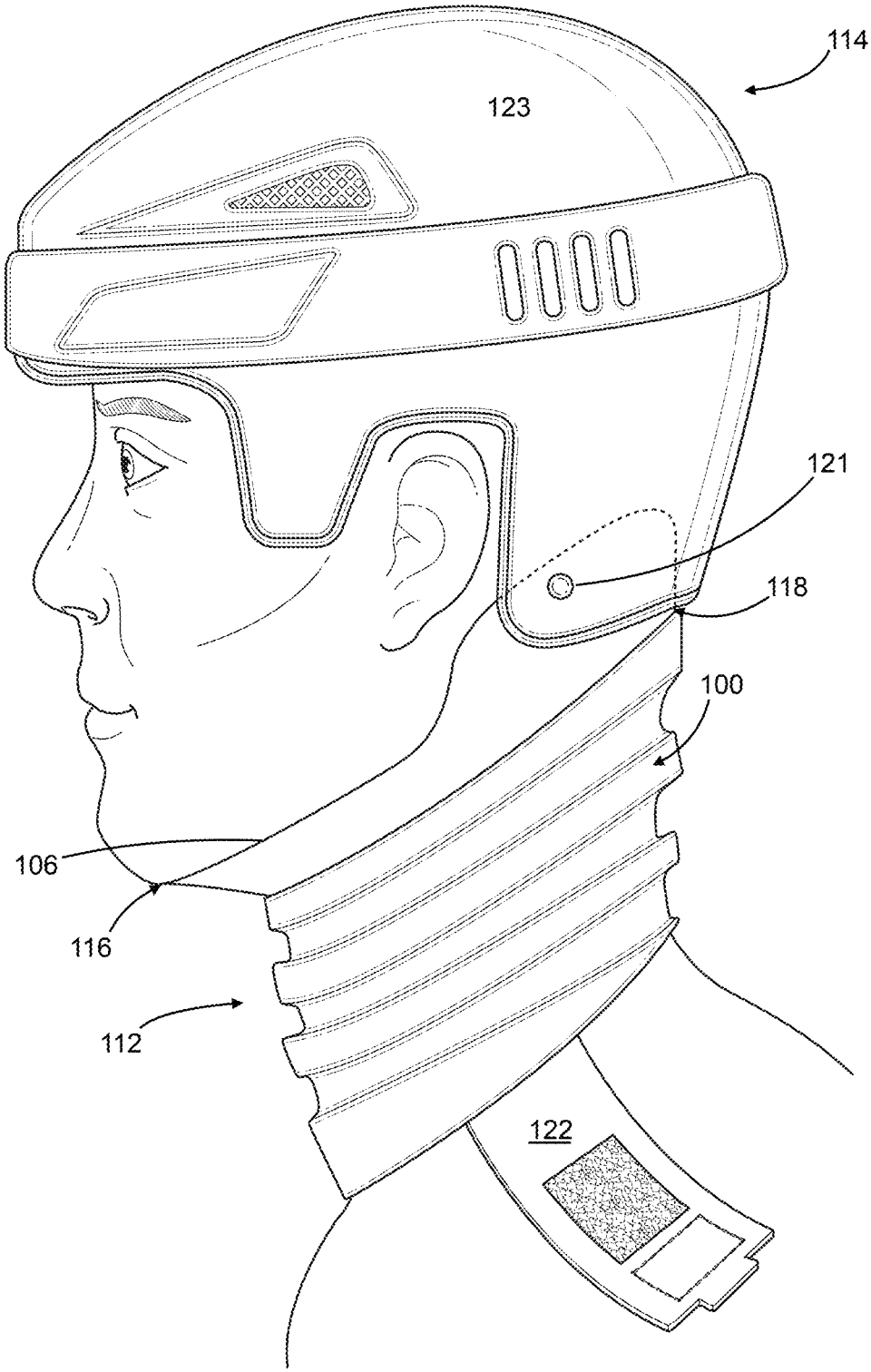
FIG. 1 shows a perspective view of one embodiment of the neck guard being worn.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, the neck guard 100 may be a slash-resistant material configured to encircle a wearer's 110 neck 112. In some embodiments, the neck guard 100 is a continuous, and even in some embodiments, a seamless tube and may be therefore sized to allow a wearer's 110 head 114 to pass therethrough. It is contemplated, however, that the neck guard 100 may comprise a length of material having opposing first and second ends (not shown, but known to those of ordinary skill in the art) securable to one another about the wearer's neck, such as laces, by way of complementary snaps, hook and loop fasteners, buckles, and the like, integrated at such first and second ends.

Figure 2:
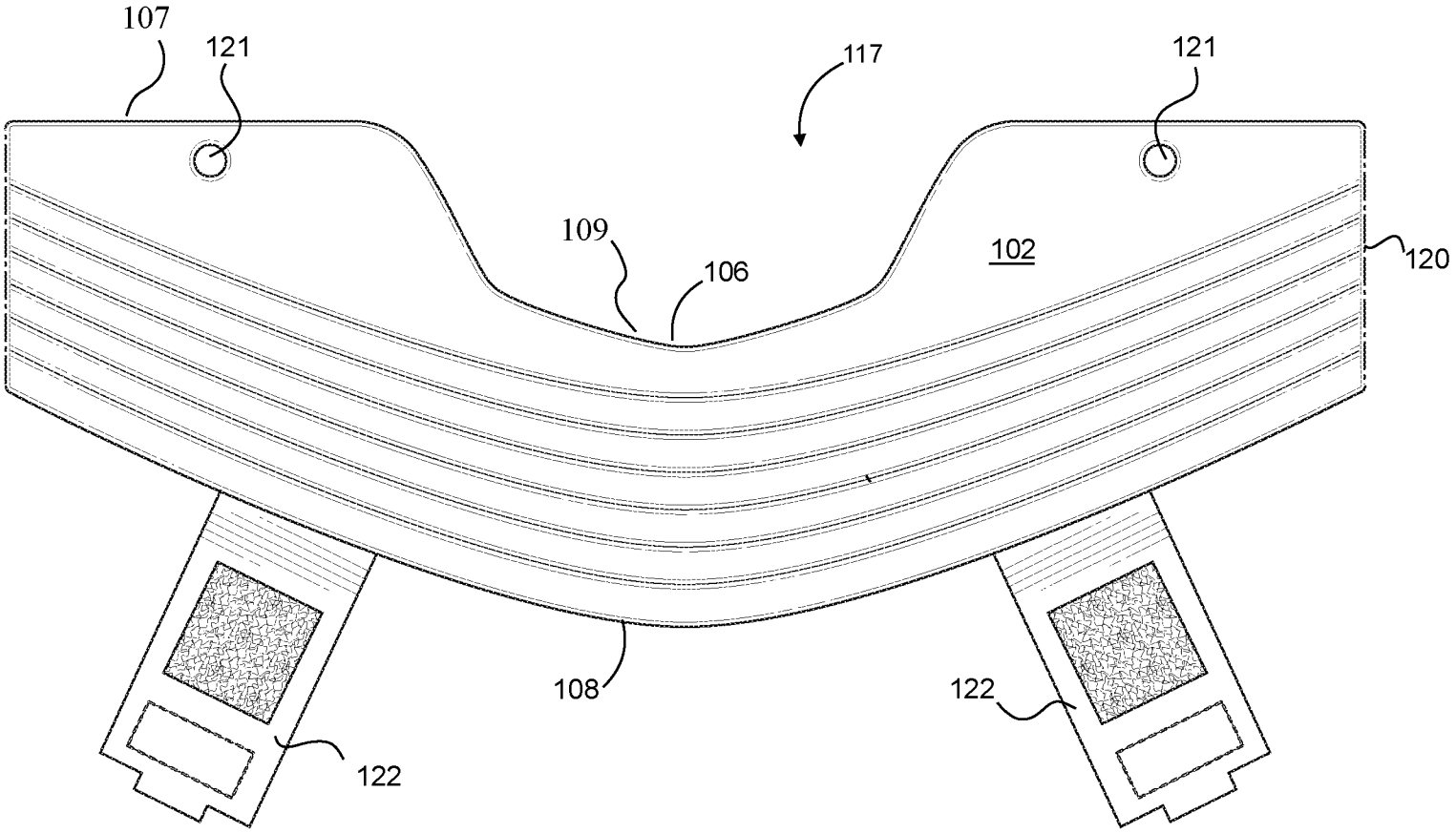
FIGS. 2 and 3 show alternative plan views of the embodiment of the neck guard from FIG. 1.
Figure 3:
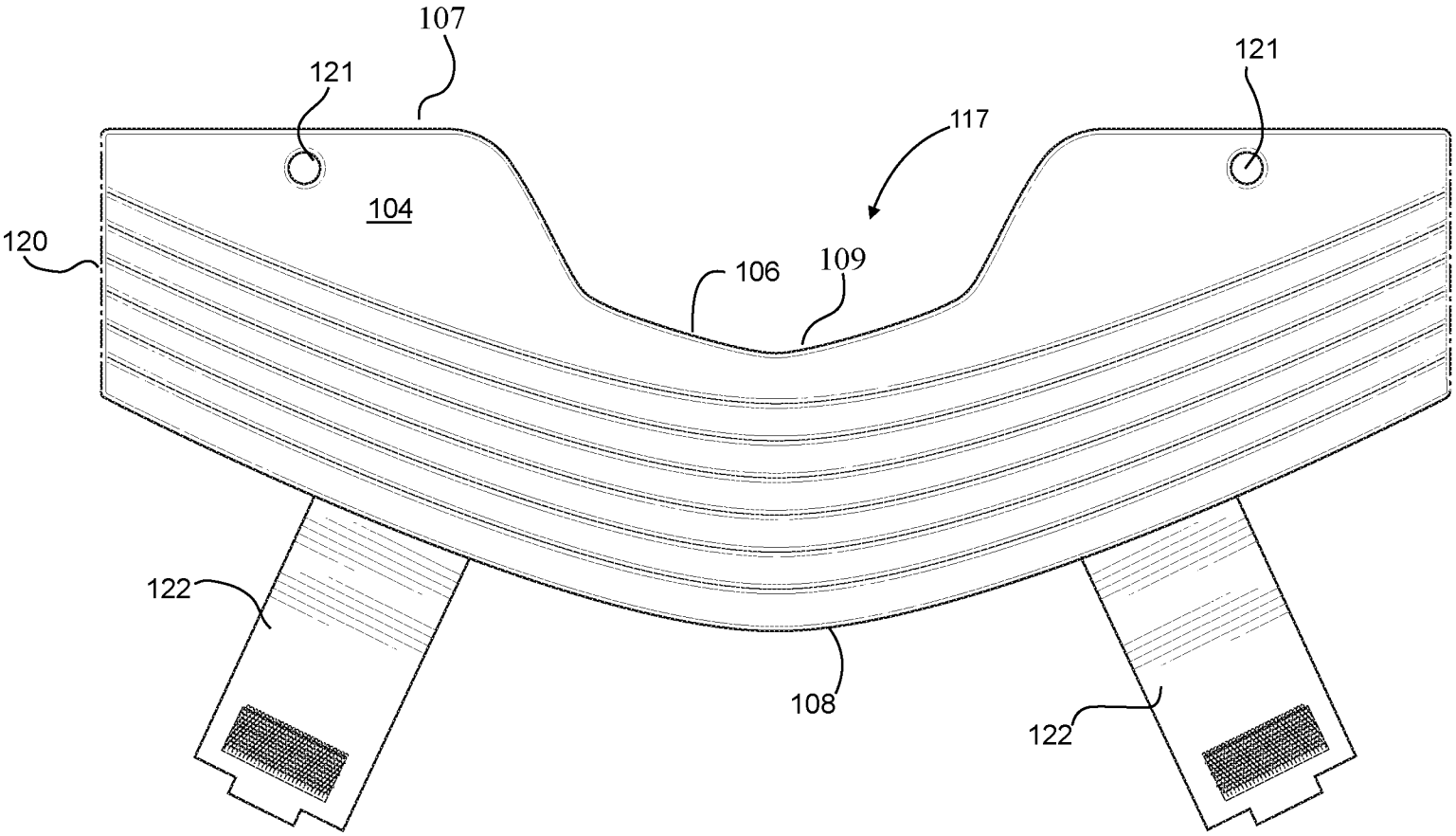
Figure 4:
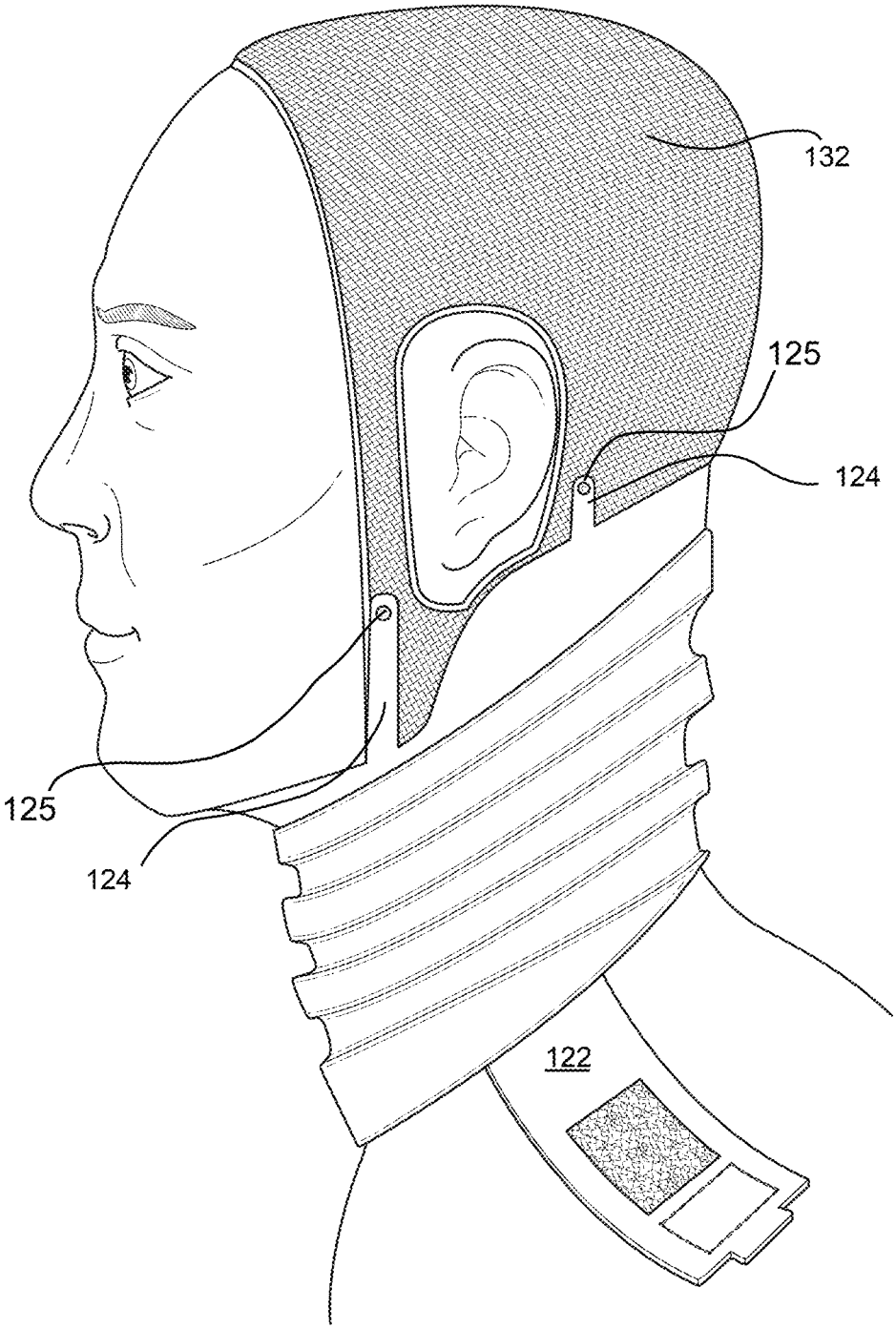
FIGS. 4-6 show alternative views of another embodiment of the neck guard being worn.

Referring now to FIGS. 2 and 3 an exemplary embodiment of the neck guard 100 defines an inside 102 and outside 104, and a top edge 106 and bottom edge 108 spaced apart from one another. Note that the neck guard 100 here is illustrated as a flattened tube for the purposes of illustrating certain features of the invention, though it is contemplated that closures may be provided as described above.

In an exemplary embodiment, the top edge 106 may be shaped to follow the contours of the wearer's jaw 116 and skull 118, as may be seen in FIG. 1, for example, at the top of the neck 112 when worn. To that end, a rear top edge portion 107 of the neck guard 100 may be relatively higher in position than a front top edge portion 109 of the neck guard 100. In other words, a front top edge portion 107 of the neck guard 100 may define a cutout 117 shaped to follow the contours of the wearer's jaw, while a rear top edge portion 109 of the neck guard 100 may rise to protect the base of a wearer's skull, at the top of their neck 112. It is contemplated that this may aid protection of a significant portion, if not the entirety of, the wearer's neck 112 and throat while worn.

Figure 5:
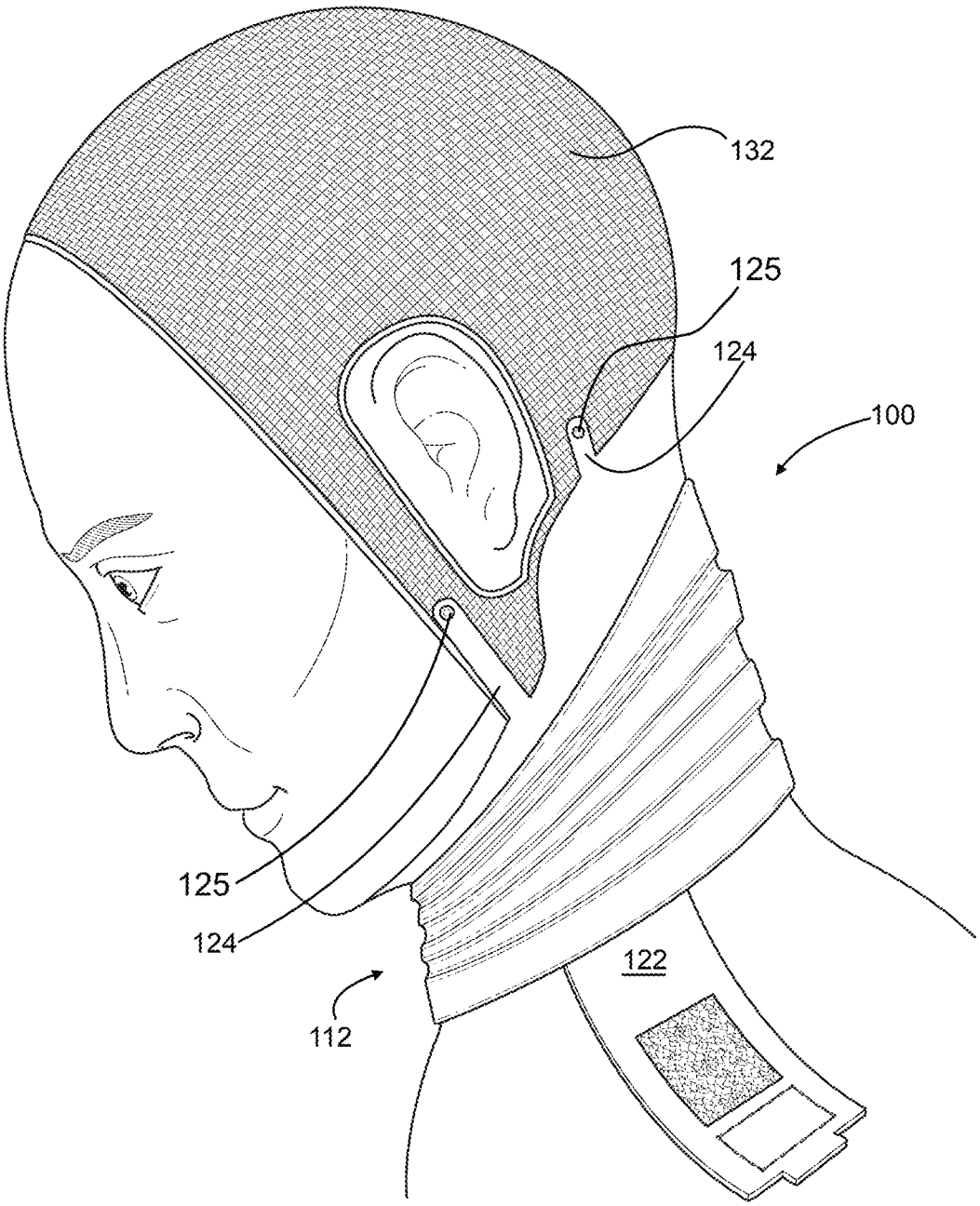
Figure 6:
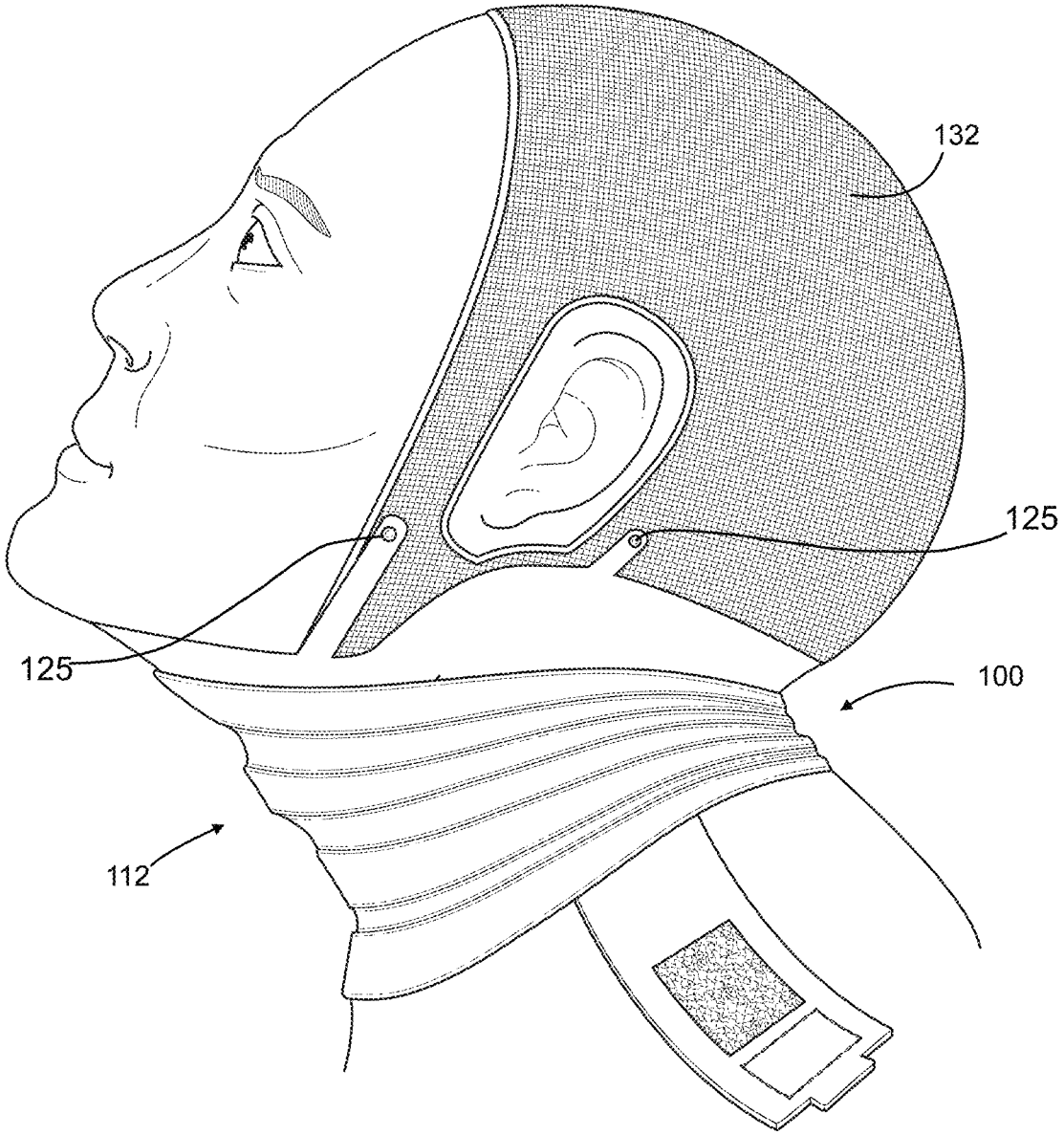

Returning to FIGS. 2 and 3, in some embodiments, material comprising the neck guard 100 may be knitted or otherwise configured to form a series of vertically stacked grooves 120, pleats, ribs, or indentations encircling a wearer's neck 112 that allow the material to fold, bend, compress, and stretch ergonomically when the wearer's head moves during participation in sports activities and even, in some embodiments, throughout its entire range of motion, as illustrated in FIGS. 5 and 6. Indeed, it is contemplated that some degree of elasticity may be desired in order to allow the device to fit comfortably over the wearer's head while maintaining a relatively close fit around the wearer's neck 112, and therefore, in some embodiments, the neck guard 100 may comprise material that is at least somewhat elastic and resilient. To that end, the slash-resistant material may be a seamless, knitted textile made from high-strength fibers such as aramid, para-aramid, polyethylene, ultra-high-molecular-weight polyethylene, or nylon.

The particular weight and/or thickness of the neck guard may vary as needed or desired to provide varying levels of cut resistance. This can be determined by user preference, or even by industry or league standards. In some embodiments, the neck guard 100 may comprise material that can withstand a cutting force between about 1000 grams to about 4000 grams.

The material may also be blended with additional materials, such as elastane, and others for enhanced properties, like further strength and durability, stretch, breathability, sweat wicking properties, and the like. Indeed, in some embodiments, the neck guard 100 may comprise additional lining layers comprising fabrics such as polyester, wool, microfiber blends, and others materials and blended materials known to those of ordinary skill in the art for having beneficial properties for comfort against the skin, reducing microbial loads, moisture wicking, cooling, and the like as needed or desired. For those embodiments in which the neck guard 100 is a continuous tube, it is contemplated that means for adjusting the diameter of the tube around the neck of the wearer, known to those of ordinary skill in the art, for comfort and safety, may be provided. For example only, and not limitation, in some embodiments, complementary hook and loop tabs may be secured to an outer surface of the neck guard 100 and optionally engaged with one another to tighten or release the diameter of the neck guard 100 around the wearer's neck 112.

Figure 7:
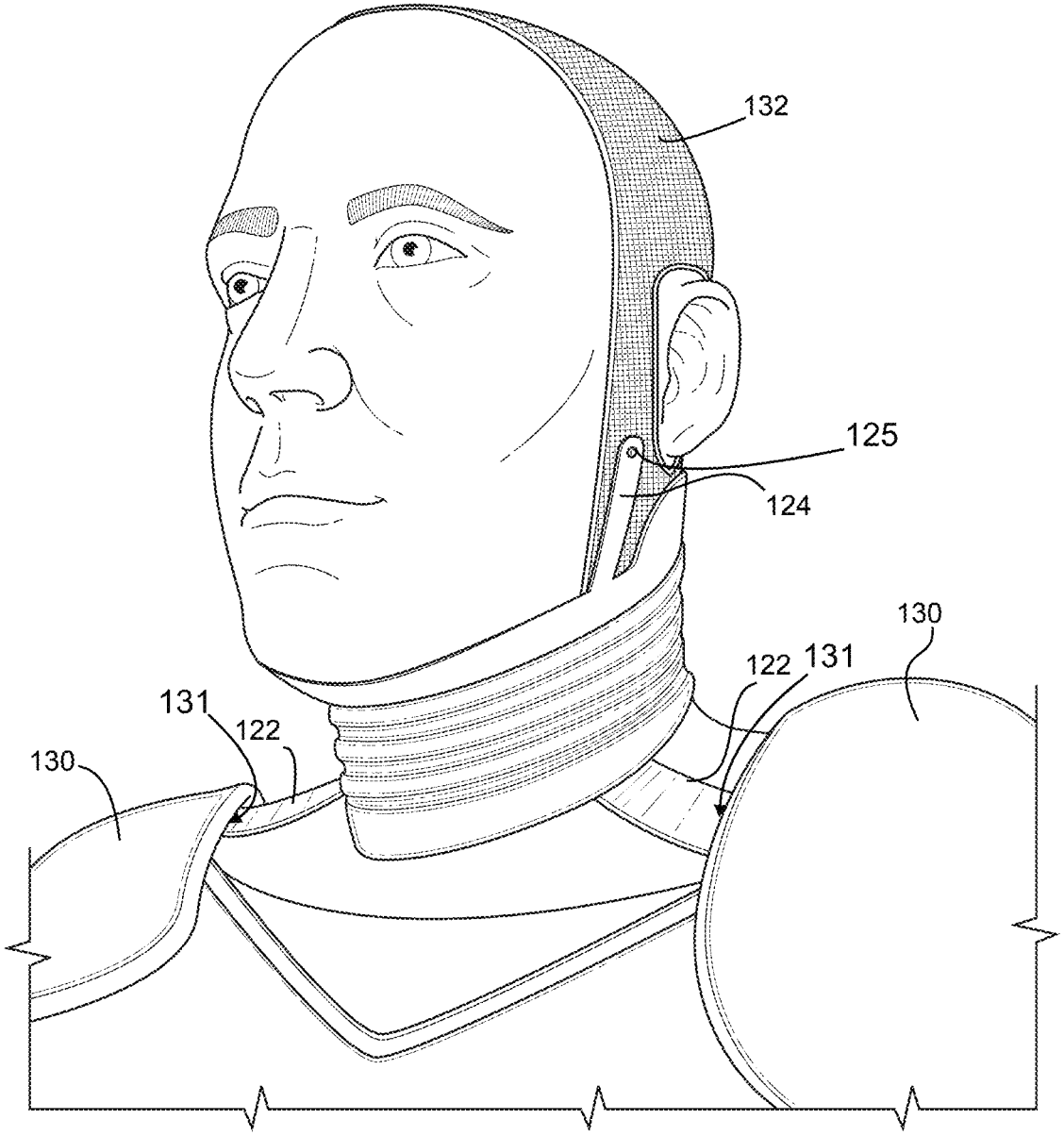
FIG. 7 shows yet another view of an embodiment of the neck guard being worn.

Returning again to FIGS. 2 and 3, the neck guard 100 may further comprise a plurality of mechanisms for securing the neck guard 100 to one or more other devices from the top edge 106 and the bottom edge 108. In some exemplary embodiments, one or more means for securing the neck guard 100 to another device may comprise one or more straps 122 extending from the bottom edge 108 of the neck guard 100 and configured to securely yet releasably engage with an anchor point on a garment or accessory worn on the upper body of a player. For instance, with reference to FIG. 7, the straps 122 may releasably engage an anchor point 131 on a player's shoulder pads 130, an undershirt, or jersey. In some embodiments, the straps 122 may comprise complementary hook-and-loop fasteners, shown in FIGS. 2 and 3, or snaps, laces, buckles, buttons and/or buttonholes.

One or more means for securing the neck guard 100 to another device may comprise at least one hole 121 defined by the surface of the neck guard 100 configured to secure to a helmet 123, as in FIG. 1 with any means known to those of ordinary skill in the art as capable of so doing. For instance, a notch, hook, screw, button, clasp, or the like may be provided to engage such hole or other means disposed along the top edge 106 of the neck guard 100.

As another example, shown in FIGS. 4-7, one or more straps 124 may extend from the top edge 106 of the neck guard 100 and configured to securely yet releasably engage with an anchor point on a helmet, such as a portion of a face cage, visor, or on an anchor point 125 on any non-helmet garment or accessory worn on or around or proximate to the head of a player. In the figures, such garment or accessory is shown as a protective, sweat wicking, or even warming, hood 132, though it is contemplated that this garment or accessory may be a balaclava, headband, or any other garment or accessory capable of supporting the neck guard 100 in position around the neck of the wearer. In still further embodiments, the garment or accessory, such as a hood, balaclava, or headband, may itself be fully integrated along the top edge 106 of the neck guard 100. As above, any means for releasably securing the top edge 106 of the neck guard 100 may be utilized without departing from the invention. For instance, complementary snaps, hook and loop fasteners, buckles, laces, and the like, may be integrated on the one or more straps 124 and garment or accessory as needed or desired.

It is contemplated that means for securing the neck guard 100 to another device from the top and bottom edges of the neck guard 100 may be disposed on the neck guard 100 to symmetrically anchor the neck guard 100 in position from the wearer's left and right sides.

Foam padding and even rigid plastic, metal, or composite plates may be secured to the neck guard 100 for added protection.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the color and any design applied to the neck guard may vary without departing at all from the invention.

Accordingly, it is intended that the invention not be limited, except as by the appended claim(s).

The teachings disclosed herein may be applied to other systems and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Particular terminology used when describing certain features or aspects of the invention should not be taken to imply that the terminology is being refined herein to be restricted to any specific characteristics, features, or aspects of the neck guard with which that terminology is associated. In general, the terms used in the following claims should not be constructed to limit the neck guard to the specific embodiments disclosed in the specification unless the above description section explicitly define such terms. Accordingly, the actual scope encompasses not only the disclosed embodiments, but also all equivalent ways of practicing or implementing the disclosed system, method, and apparatus. The above description of embodiments of the neck guard is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the neck guard.

What is claimed is:

1. A neck guard for protecting a wearer's neck and throat from injury, comprising:

a continuous, slash-resistant tube defining an inside, an outside, a contoured top edge, and a curved bottom edge;

at least one means for securing the tube to another device disposed along the top edge;

at least a first and second strap as means for securing the tube to a garment or accessory worn on the wearer's upper body or torso extending from opposing sides of the bottom edge of the tube;

wherein the tube is sized to receive a wearer's head through the inside and configured to be positioned around the neck of the wearer, and wherein a rear portion of the contoured top edge is relatively higher than a front portion of the top edge, the front portion of the top edge defining a cutout, the top edge thereby shaped to accommodate the contours of a wearer's jaw and rise to cover a base of the wearer's skull along the top of the wearer's neck.

2. The neck guard of claim 1, wherein the slash-resistant tube comprises a seamless, knitted material in a high-strength textile fiber.

3. The neck guard of claim 2, wherein the high-strength textile fiber is selected from the group consisting of aramid, para-aramid, polyethylene, ultra-high-molecular-weight polyethylene, and nylon.

4. The neck guard of claim 2, wherein the knitted material is blended with additional material.

5. The neck guard of claim 1, wherein the tube is configured to form a series of vertically stacked grooves, pleats, ribs, or indentations encircling a wearer's neck when worn that allow the tube to fold, bend, compress, and stretch ergonomically when a wearer's head moves throughout its entire range of motion.

6. The neck guard of claim 1, wherein the tube further comprises one or more pieces of foam padding, plastic, metal, or composite plates secured to the tube.

7. The neck guard of claim 1, wherein the means for securing the tube to another device disposed along the bottom edge comprises hook and loop fasteners operative to releasably secure the neck guard around an anchor point integrated on a garment or accessory worn on the wearer's upper body or torso.

8. The neck guard of claim 1, wherein the at least one means for securing the tube to another device disposed along the top edge comprises one or more elastic straps configured to secure to a garment or accessory worn on the wearer's head.

9. The neck guard of claim 1, wherein the at least one means for securing the tube to another device disposed along the top edge comprises at least one hole defined by the surface of the tube, and such hole is configured to secure to a helmet.

10. A neck guard for protecting a wearer's neck and throat from injury, comprising:

a continuous, slash-resistant tube defining an inside, an outside, a contoured top edge, and a bottom edge and sized to receive a wearer's head through the inside and configured to be positioned around the neck of the wearer, the tube comprising knitted material in a high-strength textile fiber configured to form a series of vertically stacked grooves, pleats, ribs, or indentations encircling a wearer's neck when worn that allow the material to fold, bend, compress, and stretch ergonomically when the wearer's head moves throughout its entire range of motion; and means for vertically removably securing the tube to another device comprising at least a first and second strap extending from opposing sides of the bottom edge of the tube and configured to secure to a garment or accessory worn on the wearer's upper body or torso;

wherein a front portion of the top edge defines a cutout shaped to follow contours of the wearer's jaw, and a rear portion of the top edge is relatively higher than the front portion and rises to cover a base of the wearer's skull when worn.

11. The neck guard of claim 10, wherein the high-strength textile fiber is selected from the group consisting of aramid, para-aramid, polyethylene, ultra-high-molecular-weight polyethylene, and nylon.

12. The neck guard of claim 10, wherein the knitted material is blended with additional stretchy and resilient material.

13. The neck guard of claim 10, wherein the tube further comprises one or more pieces of foam padding, plastic, metal or composite plates secured to the tube.

14. The neck guard of claim 10, wherein the means for vertically removably securing the tube to another device comprises at least one means for securing the tube to another device disposed along the bottom edge of the tube and at least one means for securing the tube to another device disposed along the top edge of the tube.

15. The neck guard of claim 14, wherein the at least one means for securing the tube to another device disposed along the bottom edge of the tube comprises hook and loop fasteners operative to releasably secure the neck guard around an anchor point integrated on a garment or accessory worn on a wearer's upper body or torso.

16. The neck guard of claim 14, wherein the at least one means for securing the tube to another device disposed along the top edge comprises one or more elastic straps configured to secure to a garment or accessory worn on the wearer's head.

17. The neck guard of claim 1, wherein the at least one means for securing the tube to another device disposed along the top edge comprises at least one hole defined by the surface of the tube, and such hole is configured to secure to a helmet.

* * * * *